US008293033B2

(12) United States Patent
Muroga et al.

(10) Patent No.: US 8,293,033 B2
(45) Date of Patent: Oct. 23, 2012

(54) ROLLED COPPER FOIL

(75) Inventors: Takemi Muroga, Tsukuba (JP); Satoshi Seki, Tsukuba (JP); Noboru Hagiwara, Tsuchiura (JP)

(73) Assignee: Hitachi Cable, Ltd., Tokyo (JP)

( * ) Notice: Subject to any disclaimer, the term of this patent is extended or adjusted under 35 U.S.C. 154(b) by 15 days.

(21) Appl. No.: 12/971,328

(22) Filed: Dec. 17, 2010

(65) Prior Publication Data

US 2011/0311836 A1 Dec. 22, 2011

(30) Foreign Application Priority Data

Jun. 18, 2010 (JP) ..... 2010-139252

(51) Int. Cl.
*C22C 9/00* (2006.01)

(52) U.S. Cl. ..... 148/432; 420/490; 420/496; 420/497

(58) Field of Classification Search ..... 420/490, 420/496, 497; 148/432
See application file for complete search history.

(56) References Cited

U.S. PATENT DOCUMENTS 4,908,275 A * 3/1990 Tsuji et al. ..... 428/457

FOREIGN PATENT DOCUMENTS

| | | | |
|---|---|---|---|
| JP | 63-149345 A | | 6/1988 |
| JP | 1056842 A | * | 3/1989 |
| JP | 2170951 A | * | 7/1990 |
| JP | 2001-64740 A | | 3/2001 |
| JP | 2002-167632 A | | 6/2002 |
| JP | 2007-270171 A | | 10/2007 |

* cited by examiner

*Primary Examiner* — Sikyin Ip
(74) *Attorney, Agent, or Firm* — Foley & Lardner LLP

(57) ABSTRACT

A rolled copper foil consisted of at least either of silicon (Si) and iron (Fe), boron (B), silver (Ag), oxygen (O) of 0.002 mass % or less, and a balance consisted of copper (Cu) and inevitable impurities.

21 Claims, 2 Drawing Sheets

ROLLED COPPER FOIL

The present application is based on Japanese Patent Application No. 2010-139252 filed on Jun. 18, 2010, the entire contents of which are incorporated herein by reference.

BACKGROUND OF THE INVENTION

1. Field of the Invention

The present invention relates to a rolled copper foil, more particularly, to a rolled copper foil to be used for a flexible printed circuit (FPC) or the like.

2. Description of the Related Art

The FPC is provided with a high degree of freedom in mounting morphology for electronic device or the like, since the FPC has a reduced thickness and superior flexibility. Therefore, the FPC has been used for a bending part of a folding type portable phone, a movable part of digital camera, printer head or the like, an electric wiring of a movable part of disc-related equipment such as Hard Disk Drive (HDD), Digital Versatile Disc (DVD), Compact Disk (CD).

Japanese Patent Laid-Open No. 2002-167632 (JP-A 2002-167632) discloses one example of conventional rolled copper foils for a flexible printed circuit having a following configuration.

Namely, the rolled copper foil for a flexible printed circuit contains oxygen (O) of 100 to 500 mass ppm, and contains at least one element selected from a group consisted of silver (Ag), gold (Au), palladium (Pd), platinum (Pt), rhodium (Rh), iridium (Ir), ruthenium (Ru), and osmium (Os) in the ranges so as to control T defined by the following formula to 100 to 400: $T=[Ag]+0.6[Au]+0.6[Pd]+0.4[Pt]+0.4[Rh]+0.3[Ir]+0.3[Ru]+0.3[Os]$ (wherein, [M] is the mass ppm concentration of the element M), and in which the total content of sulfur (S), arsenic (As), antimony (Sb), bismuth (Bi), selenium (Se) and tellurium (Te) is 30 mass ppm or less. The rolled copper foil has a thickness of 5 to 50 μm. The intensity (I) in the 200 plane obtained by X-ray diffraction for the rolled face after annealing at 200° C. for 30 min to the intensity ($I_0$) in the 200 plane obtained by X-ray diffraction for the pulverized copper, i.e., $I/I_0$ is >20. The rolled copper foil has a semi-softening temperature of 120 to 150° C., and continuously maintains tensile strength of ≧300 N/mm$^2$ at a room temperature.

According to the above structure, the rolled copper foil for a flexible printed circuit disclosed by JP-A 2002-167632 has a superior bending-fatigue life characteristic.

However, in the rolled copper foil for a flexible printed circuit disclosed by JP-A 2002-167632, when oxide is generated from the oxygen (O) contained in this copper foil, there is the case that this oxide may become an origin of fatigue breakdown. Therefore, there is a limit for enhancement of the bending-fatigue life characteristic according to this structure.

Further, in the case of using the oxygen free copper containing substantially no oxide, since a softening temperature (apparent initial softening) of the oxygen free copper per se is higher than that of copper containing oxygen (O) (of 100 to 500 mass ppm), progression of recrystallization in the copper foil is insufficient under low temperature condition (e.g. 160° C.). Therefore, a good bending-fatigue life characteristic cannot be provided. Further, if additive elements disclosed by JP-A 2002-167632 is used in the copper, the softening temperature of the copper will be further raised. Therefore, the addition of the additive elements is advantageous under a high temperature condition (e.g. 400° C.). However, the copper containing such additive elements cannot be used under the low temperature condition. Still further, if no additive element is added to the oxygen free copper, there will be no affect of the oxide. Therefore, the progression of recrystallization advances in the copper foil appropriately under the low temperature condition, so that a good bending-fatigue life characteristic is provided. On the other hand, there is the case that the bending-fatigue life characteristic falls because the recrystallization advances excessively in the copper foil under the high temperature condition. Therefore, it is not possible for the conventional rolled copper to correspond to heat treatment in a wide temperature range.

SUMMARY OF THE INVENTION

Accordingly, an object of the present invention is to provide a rolled copper foil which exhibits excellent bending-fatigue life characteristic after heat treatment in a wide temperature range.

According to the present invention, following rolled copper foil is provided so to achieve the object.

According to a feature of the invention, a rolled copper foil consists of at least either of silicon (Si) and iron (Fe), boron (B), silver (Ag), and a balance consisting of copper (Cu) and inevitable impurities.

In the rolled copper foil, a total amount of at least either of the silicon (Si) and the iron (Fe) is 0.001 to 0.01 mass %, an amount of the boron (B) is 0.003 to 0.04 mass %, and an amount of the silver (Ag) is 0.002 to 0.025 mass %.

According to another feature of the invention, a rolled copper foil consists of at least either of silicon (Si) and iron (Fe), boron (B), silver (Ag), oxygen of 0.002 mass % or less, and a balance consisting of copper (Cu) and inevitable impurities.

The rolled copper foil may have a thickness of 20 μm or less.

In the rolled copper foil, the amount of the silver (Ag) is preferably 0.0025 to 0.0225 mass %.

In the rolled copper foil, the amount of the silver (Ag) is more preferably 0.003 to 0.02 mass %.

In the rolled copper foil, the amount of the silver (Ag) is 0.0085 mass %

In the rolled copper foil, the amount of the boron (B) is preferably 0.003 to 0.035 mass %.

In the rolled copper foil, the amount of the boron (B) is more preferably 0.003 to 0.03 mass %.

In the rolled copper foil, the amount of the boron (B) is 0.0145 mass %.

Effects of the Invention

According to the present invention, it is possible to provide a rolled copper foil which exhibits excellent bending-fatigue life characteristic after heat treatment in a wide temperature range.

BRIEF DESCRIPTION OF THE DRAWINGS

The preferred embodiment according to the invention will be explained below referring to the drawings, wherein.

DETAILED DESCRIPTION OF THE PREFERRED EMBODIMENT

Figure 1:
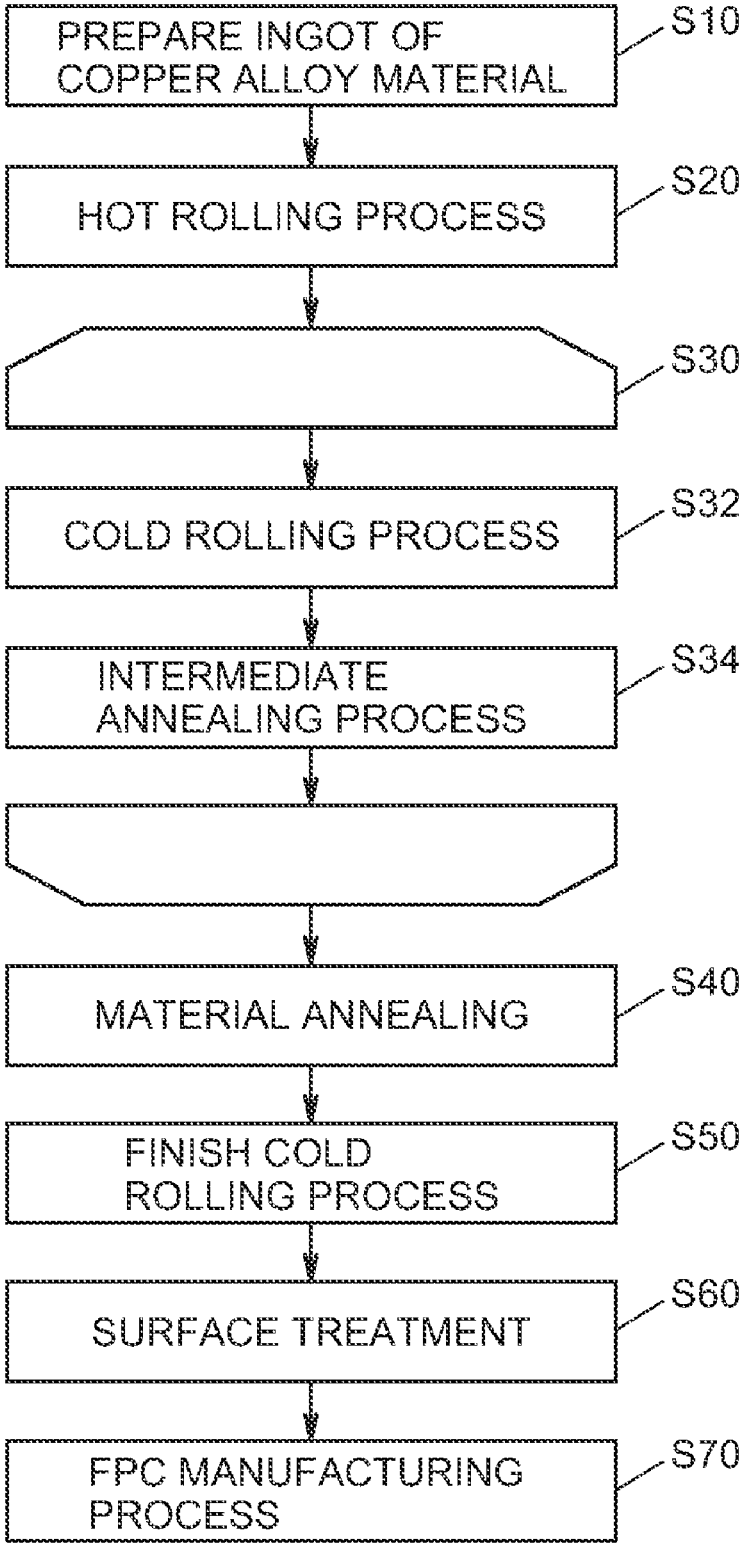
FIG. 1 is a flow chart showing a process of manufacturing a rolled copper foil in the embodiment according to the present invention.

Next, the embodiment of a rolled copper foil in the embodiment according to the present invention will be explained below in more detail in conjunction with appended drawings.

A rolled copper foil in the embodiment, a rolled copper foil consists of at least either of silicon (Si) and iron (Fe), boron (B), silver (Ag), oxygen (O) of 0.002 mass % or less, and a balance consisting of copper (Cu) and inevitable impurities. In other words, the rolled copper foil consists of copper (Cu) and inevitable impurities (Hereinafter, collectively referred to as "copper (Cu)") as principal (main) component (base material), at least either of silicon (Si) and iron (Fe), boron (B), and silver (Ag), and oxygen is 0.002 mass % or less. If possible, a content of oxygen may be zero.

Further, the rolled copper foil in the embodiment is suitably used for a flexible electric wiring member such as the aforementioned flexible printed circuit (FPC). As described above, the rolled copper foil in the embodiment comprises copper (Cu) and inevitable impurities as the base material at least either of silicon (Si) and iron (Fe), boron (B) and silver (Ag). More concretely, as an example, the rolled copper foil in the embodiment is a rolled copper foil which is obtained after having passed through a finish cold rolling process in manufacturing process of the rolled copper foil to be described later and before (prior to) passing through recrystallization annealing. The rolled copper foil in this embodiment is formed to have a thickness of 50 μm or less normally, and preferably 20 μm or less for the purpose of e.g. a rolled copper foil for FPC.

Each component of the rolled copper foil will be explained more in detail as follows.

(Copper (Cu))

The rolled copper foil in the embodiment contains the copper (Cu) and the inevitable impurities as the base material. For the copper (Cu) to be used in this embodiment, oxygen free copper or quasi oxygen free copper (Cu) material may be proposed. The rolled copper foil in the embodiment may be formed by using the above metals as this base material. Herein, the "oxygen free copper" used in this embodiment includes oxygen free copper pursuant to JIS C1020, and copper (Cu) having purity of 99.96% or more which does not contain copper I oxide [$Cu_2O$] and/or residual deoxidizer.

Herein, it is preferable that oxygen content is completely zero. However, in general, oxygen (O) content is not completely zero, and the "oxygen free copper" used in this embodiment does not exclude oxygen free copper containing oxygen (O) of about several ppm (0.000 several %). Therefore, the rolled copper foil used for this embodiment may be formed to contain oxygen (O) of e.g. 20 ppm or less. In addition, it is preferable to reduce the oxygen (O) content so as to suppress generation of oxide in the rolled copper foil.

Further, it is observed that the softening temperature of the oxygen free copper tends to be raised by solid solution of the impurities inevitably included (inevitable impurities) such as sulfur (S), phosphorus (P) in this oxygen free copper into the rolled copper foil in the embodiment. On the other hand, it is also observed that the softening temperature of the oxygen free copper tends to fall when there is a compound generated from reaction between the inevitable impurities (e.g. sulfur (S), phosphorus (P)) and a predetermined additive element in the oxygen free copper.

(Boron (B))

The rolled copper foil in the embodiment contains boron (B). Boron (B) used in this embodiment has a function of lowering a softening temperature of the manufactured rolled copper foil, namely, function of starting recrystallization from a lower temperature. Herein, an upper limit of the content of boron (B) is determined to be 0.04 mass %, since the content of boron (B) exceeds 0.04 mass %, boron (B) and copper (Cu) of the base material generate a compound (B—Cu) and this compound (B—Cu) exists as inclusion in the base material. When B—Cu exists as inclusion in the base material, dislocation accumulates on this inclusion during inflection movement, thereby causing metal fatigue (namely, fast accumulation of the metal fatigue causes low bending characteristics).

(Silver (Ag))

The rolled copper foil in the embodiment contains silver (Ag). Silver (Ag) used in this embodiment provides an effect of controlling (suppressing) grain growth speed of a crystal grain after recrystallization of the rolled copper foil to be manufactured.

(Silicon (Si) and iron (Fe))

The rolled copper foil in the embodiment contains at least either of silicon (Si) and iron (Fe). Silicon (Si) and/or iron (Fe) used in this embodiment provides an effect of controlling (suppressing) the grain growth speed of the crystal grain after the recrystallization of the rolled copper foil to be manufactured, similarly to the silver (Ag). A difference in effect of the silicon (Si) and/or iron (Fe) from the silver (Ag) is a degree of the effect of suppressing the grain growth speed after the recrystallization. More concretely, the grain growth speed suppressing effect of the silicon (Si) and/or iron (Fe) is greater than that of the silver (Ag). Therefore, adverse effects may occur in growth of the recrystallized grain when silicon (Si) and/or iron (Fe) are contained excessively, so that deterioration in bending characteristics may be caused. Accordingly, it is preferable that an upper limit of the content (total amount) of at least one of silicon (Si) and iron (Fe) is 0.01% by weight or less.

Herein, there is little difference in effect between silicon (Si) and iron (Fe). In other words, when only either of silicon (Si) and iron (Fe) is contained or when both silicon and iron are contained, the effect of the present invention will be achieved similarly in any of these cases as long as the total amount is the same.

(Oxygen (O))

The rolled copper foil in the embodiment may contain oxygen (O). When the oxygen (O) is contained excessively in this embodiment, the oxygen (O) and the copper (Cu) of the base material generate a copper oxide and this copper oxide exists as inclusion in the base material. Similarly to the B—Cu compound, dislocation accumulates on this inclusion (copper oxide) during inflection movement, thereby causing metal fatigue (Fast accumulation of the metal fatigue causes low bending characteristics).

The content (total) of the inevitable impurities is usually 0.04% (400 ppm) or less.

(Process to Achieve this Embodiment)

The process to achieve this embodiment that adopts the above configuration will be explained below.

As described above, the rolled copper foil in the embodiment is formed by using the oxygen free copper or quasi oxygen free copper as the base material. At first, the boron (B) reacts with the inevitable impurities such as sulfur (S), phosphorus (P), thereby generates a compound. At this stage, the softening temperature of the copper (Cu) which is the base material may be raised due to the solid solution of the sulfur (S), phosphorus (P) into the copper (Cu) as the base material. However, since the compound is generated from a combination of the sulfur (S), phosphorus (P) or the like with the boron (B), the solid solution of the sulfur (S), phosphorus (P) or the like into the copper (Cu) as the base material can be suppressed. According to this, it is possible to suppress the elevation of the softening temperature of the copper (Cu) which is the base material.

It has been considered that one of main factors of the high softening temperature of normal oxygen free copper is the solid solution of the inevitable impurities such as sulfur (S), phosphorus (P) into copper (Cu) as the base material. However, the reason that the softening temperature of the normal oxygen free copper is high cannot be explained completely only by the above reason. In other words, it is assumed that there would be other factors. However, it is not certain in concrete manner at present. At least, it is experimentally approved that the softening temperature of the oxygen free copper doped with boron (B) falls than that of the normal oxygen free copper which is not doped with boron (B).

In the rolled copper foil in this embodiment, the softening temperature falls because of the doped boron (B). A heat treatment process for softening the rolled copper foil is in general carried out by heat treatment in the FPC manufacturing process. Namely, heat treatment condition is varied in accordance with variation of a manufacturing place, so that it is necessary to correspond to various heat treatment conditions. When the softening temperature is lowered by boron (B), i.e. recrystallization temperature is lowered by boron (B), appropriate recrystallization can be achieved in the FPC manufacturing process in which the heat treatment is carried out at low temperature. However, the bending characteristics falls, since the growth of recrystallized grain is accelerated and the recrystallized grain is excessively grown in the FPC manufacturing process, in which heat treatment is carried out at high temperature as described above.

Particularly, in recent years, the FPC manufacturing process including the heat treatment process at lower temperature than the conventional FPC manufacturing process becomes less frequent, while the FPC manufacturing process including the heat treatment process at higher temperature than the conventional FPC manufacturing process becomes more frequent. Therefore, it is necessary to satisfy both requirements, i.e. lowering the softening temperature (recrystallization temperature) and suppressing the growth speed of recrystallized grain. The Inventors found that it is effective to lower the softening temperature (recrystallization temperature) by doping boron (B) to the copper (Cu), and doping the copper (Cu) with a combination of "silver (Ag), silicon (Si) and iron (Fe)", "silver (Ag) and silicon (Si)" or "silver (Ag) and iron (Fe)" so as to satisfy the both requirements.

In other words, there is the case that the effect obtained by using silver (Ag) is not always enough to adopt to the higher temperature condition which is used recently, and there is also the case that the effect obtained by using silver (Ag) is not always enough to control the recrystallization grain growth. On the other hand, when only silicon (Si) and/or iron (Fe) is used without using silver (Ag), the effect of suppressing the recrystallization grain growth is too strong, so that the recrystallization grain growth becomes insufficient. Therefore, as a result of having examined this phenomenon in various ways, the Inventors found that delicate control, namely lowering of the softening temperature (recrystallization temperature) and optimization of the recrystallization grain growth suppression effect can be realized simultaneously, by doping a combination of "boron (B), silver (Ag), silicon (Si) and iron (Fe)", "boron (B), silver (Ag) and silicon (Si)" or "boron (B), silver (Ag) and iron (Fe)".

(Manufacturing Process of the Rolled Copper Foil)

FIG. 1 is a flow chart showing a process of manufacturing a rolled copper foil in the embodiment according to the present invention.

Next, a method for fabricating the rolled copper foil will be explained with referring to a flow chart shown in FIG. 1

At first, as raw material, an ingot of copper alloy material is prepared (ingot preparing step: Step 10, and hereinafter a step is referred to as "S"). For example, the ingot of the copper alloy material comprising oxygen free copper containing oxygen (O) of 2 ppm or less (e.g. JISH3100, JISC1020) as base material, and a predetermined total amount of silicon (Si) and iron (Fe), a predetermined amount of boron (B) and a predetermined amount of silver (Ag).

Next, hot rolling is carried out on the ingot to manufacture a sheet (hot rolling process: S20). Successively to the hot rolling process, cold rolling for the sheet (cold rolling process: S32) and annealing for the cold rolled sheet (intermediate annealing process: S34) are repeatedly carried out for a predetermined number of times (S30). Herein, the intermediate annealing process (S34) is a process for relaxing work hardening of the sheet on which the cold rolling was carried. According to the above processes, a copper strip called as "material" (hereinafter the material may be referred to as "copper strip before a finish cold rolling process") is manufactured.

Successively, a predetermined annealing is carried out on this copper strip (material annealing process: S40). In the material annealing process, it is preferable to carry out the heat treatment for sufficiently relaxing a working distortion due to each process before (prior to) passing through the material annealing process, e.g. substantially full annealing process. Successively, cold rolling is carried on the material on which the annealing was carried out (hereinafter referred to as "annealed material") (Finish cold rolling process (finishing rolling process): S50). According to these processes, the rolled copper foil having a predetermined thickness in the embodiment is manufactured.

In addition, when the rolled copper foil in this embodiment which is manufactured according to the aforementioned processes is used for fabricating the FPC, it is possible to successively carry out the process for manufacturing the FPC to be explained later on the rolled copper foil in this embodiment. For this case, surface treatment or the like is firstly carried out on the rolled copper foil which has passed through the finish cold rolling process (surface treatment process: S60). Next, the rolled copper foil on which the surface treatment or the like was carried out is supplied for manufacturing process of the FPC (FPC manufacturing process: S70). The FPC comprising the surface treated rolled copper foil provided by carrying out the surface treatment on the rolled copper foil in the embodiment can be obtained by passing the rolled copper foil through the FPC manufacturing process (S70).

(FPC Manufacturing Process)

Next, an outline of the FPC manufacturing process will be explained below.

The FPC manufacturing process comprises for example a process of forming a copper claded laminate (CCL) by adhering a copper foil for FPC to a base film (base material) comprising resin or the like (CCL process), a process of forming a circuit wiring on the CCL by etching or the like (wiring forming process), and a process of carrying out surface treatment for the purpose of protecting the wiring on the circuit wiring (surface treatment process).

As to the CCL process, there are two methods either of which can be used appropriately. Namely, the first method is to laminate the copper foil and the base material via an adhesive, then to cure the adhesive by heat treatment to cohere the copper foil and the base material, thereby providing a laminate structure (three-layer CCL). The second method is to directly stick a surface treated copper foil to the base material without providing an adhesive, then to integrate the surface treated copper foil and the base material by heating and pressurizing, thereby providing a laminate structure (two-layer CCL).

In the FPC manufacturing process, a copper foil on which the cold rolling was carried out (i.e. work-hardened copper foil having hardness) may be used in terms of easiness in manufacturing. It is because that deformation (e.g. transformation such as elongation, corrugation, bending) easily occurs in the copper foil which is softened by annealing when the annealed copper foil is cut or laminated on the base material, which may cause the product failure.

On the other hand, the bending-fatigue life characteristic of the copper foil is significantly improved when recrystallization annealing is carried out on the copper foil, compared with the case that the rolling is carried out on the copper foil. Thus, it is preferable to adopt the manufacturing process in which the recrystallization annealing of the copper foil is compatibly carried out by the heat treatment for cohering and integrating the base material and the copper foil in the CCL process.

In addition, the heat treatment condition of recrystallization annealing may be changed in accordance with the content of the CCL process. For example, heat treatment is carried out at a temperature of 160° C. or more and 400° C. or less for 1 minute or more and 120 minutes or less. Alternatively, the recrystallization annealing may be carried out in another process independently from the heat treatment carried out in the CCL process. It is possible to manufacture the copper foil having recrystallized structure by the heat treatment of within the aforementioned temperature range. In the FPC, the bending-fatigue life of the base film comprising resin such as polyimide is remarkably longer than the bending-fatigue life of the copper foil remarkably. Therefore, the bending-fatigue life of the whole FPC is to depend upon the bending-fatigue life of the copper foil greatly.

Effects of the Embodiment

According to the rolled copper foil in the embodiment of the present invention, it is possible to lower the softening temperature (recrystallization temperature) and slowing the grain growth speed after the recrystallization, by doping the oxygen free copper as the base material with a predetermined amount of boron (B), a predetermined amount of silver (Ag), and a predetermined total amount of silicon (Si) and/or iron (Fe). Therefore, the appropriate recrystallization of this copper foil can be achieved within a wide condition range, i.e. from the condition for the FPC manufacturing process including the low temperature heat treatment (e.g. 160° C. for 120 minutes) to the condition for the FPC manufacturing process including the high temperature heat treatment (e.g. 400° C. for 60 minutes), and this copper foil exhibits superior bending-fatigue life characteristic. Accordingly, the rolled copper foil in this embodiment can correspond to the heat treatment under various conditions in the FPC manufacturing process.

In addition, since the rolled copper foil in this embodiment exhibits the superior bending-fatigue life characteristic as described above, it is possible to use this rolled copper foil for a flexible printed circuit, a flexible wiring of other conductive member or the like suitably. Even more particularly, the rolled copper foil in this embodiment may be applied for a conductive member requiring characteristics having a correlation to some extent between the bending-fatigue life characteristics and vibration resistance property without any load resistance or vibration resistance property in a non-fixed state.

EXAMPLES

Next, the rolled copper foil of the present invention will be explained more concretely by Examples. In addition, the present invention is not a limited to the following Examples.

Example 1

At first, after having dissolved the main raw material comprising oxygen free copper as a base material in a fusion furnace, silicon (Si) of 25 ppm and iron (Fe) of 10 ppm (i.e., silicon (Si) and iron (Fe) of 35 ppm in total), boron (B) of 215 ppm and silver (Ag) of 110 ppm were doped to the base material, to manufacture an ingot with a thickness of 150 mm and a width of 500 mm (ingot preparing process). Next, according to the manufacturing method of the rolled copper foil in this embodiment, hot rolling was carried out on the ingot to form a sheet with a thickness of 10 mm (hot rolling process). Successively, cold rolling (cold rolling process) and annealing (intermediate annealing process) were repeated on the sheet to form the "material". Then, annealing was carried out on the "material" (material annealing process). In addition, the annealing in the material annealing process was carried out by keeping the temperature at 750° C. for about 1 minute. Next, cold rolling was carried out on the annealed material which has passed through the material annealing process (finish cold rolling process). According to this process, a rolled copper foil having a thickness of 0.012 mm.

Examples 2 to 7 and Comparative Examples 1 to 7

Samples of rolled copper foil according to Examples 2 to 7 and Comparative examples 1 to 7 were prepared similarly to a sample of rolled copper foil according to Example 1 except ingredient composition (an oxygen (O) concentration in oxygen free copper, a total amount of silicon (Si) and iron (Fe), an amount of boron (B) and an amount of silver (Ag)) of each sample is varied as shown in TABLE 1. In TABLE 1, the amounts of silicon (Si), iron (Fe), boron (B), and silver (Ag) of each rolled copper foil in Examples 1 to 7 and Comparative examples 1 to 7 are analysis value obtained by ICP (Inductively Coupled Plasma) analysis.

TABLE 1

| | Silicon + Iron (Si + Fe) [ppm] | Boron (B) [ppm] | Silver (Ag) [ppm] | Oxygen (O) [ppm] |
|---|---|---|---|---|
| Example 1 | 25 + 10 = 35 | 215 | 110 | 2 |
| Example 2 | 10 + 0 = 10 | 145 | 220 | 3 |
| Example 3 | 90 + 0 = 90 | 395 | 70 | 5 |
| Example 4 | 15 + 5 = 20 | 30 | 85 | 2 |
| Example 5 | 35 + 10 = 45 | 320 | 250 | 6 |
| Example 6 | 0 + 55 = 55 | 85 | 20 | 8 |
| Example 7 | 70 + 5 = 75 | 295 | 45 | 19 |
| Comparative example 1 | 95 + 20 = 115 | 220 | 125 | 2 |
| Comparative example 2 | 5 + 0 = 5 | 375 | 245 | 2 |
| Comparative example 3 | 40 + 55 = 95 | 490 | 45 | 5 |
| Comparative example 4 | 5 + 90 = 95 | 20 | 75 | 3 |
| Comparative example 5 | 15 + 40 = 55 | 335 | 300 | 4 |
| Comparative example 6 | 0 + 55 = 55 | 95 | 10 | 7 |
| Comparative example 7 | 75 + 5 = 80 | 305 | 25 | 30 |

(Values in TABLE 1 is indicated by 5 ppm unit except that oxygen concentration is indicated by 1 ppm unit)

(Bending-Fatigue Life Test)

The bending-fatigue life test was conducted by using a sliding inflection test apparatus (Type: SEK-31B2S) made by Shinetsu Engineering Co., Ltd. in accordance with IPC standard.

Figure 2:
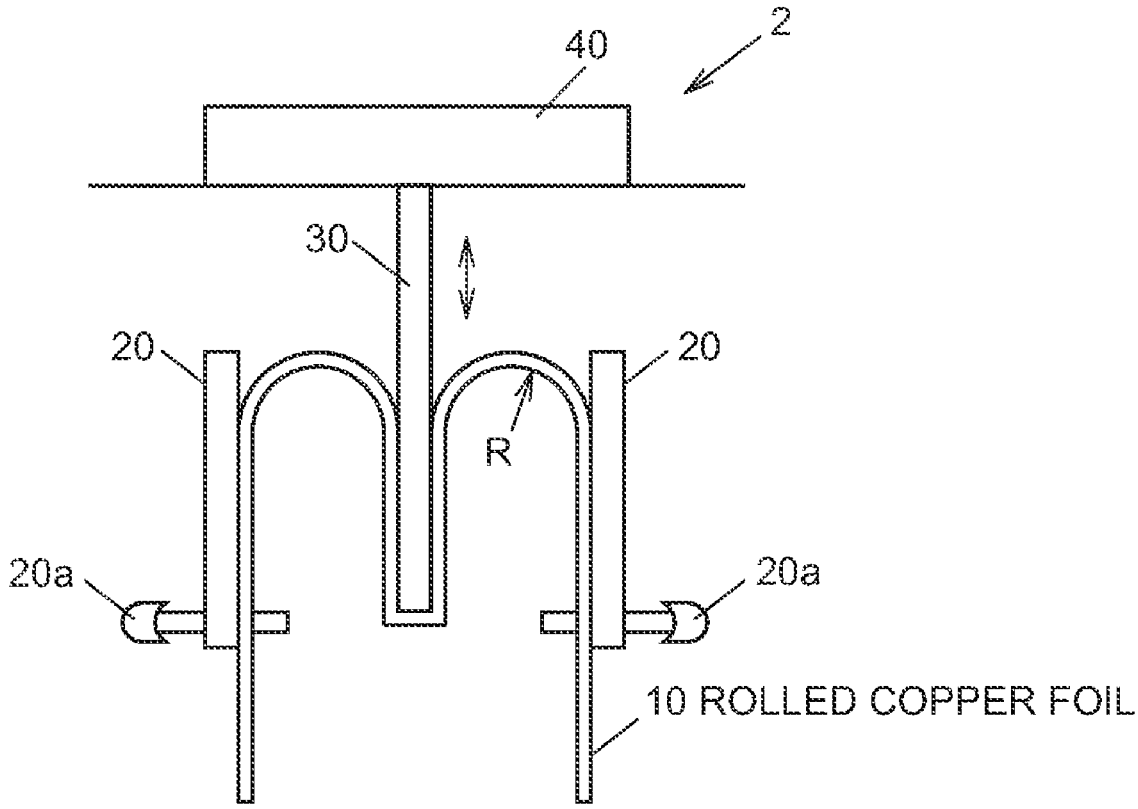
FIG. 2 is an explanatory diagram showing outline of a bending-fatigue life test (sliding inflection test) used in the embodiment according to the present invention.

Referring to FIG. 2, a sliding inflection test apparatus 2 has a sample fixing plate 20 for holding a rolled copper foil 10, a screw 20*a* for fixing the rolled copper foil 10 to the sample fixing plate 20, a vibration transmission part 30 contacting to the rolled copper foil 10 for transmitting a vibration to the rolled copper foil 10, and a vibration driver 40 for vibrating the vibration transmission part 30 in a vertical direction (upwardly and downwardly).

More concretely, a test piece having a width of 12.7 mm and a length of 220 mm was prepared from each sample of the copper rolled foils (with a thickness of 0.012 mm, i.e. 12 μm) in Examples 1 to 7 and Comparative examples 1 to 7. The recrystallization annealing at 160° C. for 120 minutes was carried out on this test piece. Thereafter, the bending-fatigue life test was carried out.

Further, a test piece having a width of 12.7 mm and a length of 220 mm was prepared from each sample of the copper rolled foils (with a thickness of 0.012 mm, i.e. 12 μm) in Examples 1 to 7 and Comparative examples 1 to 7. The recrystallization annealing at 400° C. for 60 minutes was carried out on this test piece. Thereafter, the bending-fatigue life test was carried out.

As to testing condition of the bending-fatigue life test, a curvature radius R of the rolled copper foil was 1.5 mm, a vibration stroke of the vibration transmission part 30 was 10 mm, and a frequency of the vibration driver 40 was 25 Hz (i.e. vibration velocity of 1500 times/min). In addition, a 220 mm lengthwise direction of the test piece, i.e. a longitudinal direction of the rolled copper foil 10 was aligned along a rolling direction. Measurement was carried out five times for each sample, and a mean value of measurement results for five times was compared with each other. TABLE 2 shows the measurement results.

TABLE 2

| | Silicon + Iron (Si + Fe) [ppm] | Boron (B) [ppm] | Silver (Ag) [ppm] | Oxygen (O) [ppm] | Average bending-fatigue life of a test piece subject to recrystallization annealing at 160° C. for 120 minutes [number of times] | Average bending-fatigue life of a test piece subject to recrystallization annealing at 400° C. for 120 minutes [number of times] |
|---|---|---|---|---|---|---|
| Example 1 | 25 + 10 = 35 | 215 | 110 | 2 | 3,142,000 | 2,987,000 |
| Example 2 | 10 + 0 = 10 | 145 | 220 | 3 | 3,318,000 | 3,229,000 |
| Example 3 | 90 + 0 = 90 | 395 | 70 | 5 | 2,898,000 | 2,935,000 |
| Example 4 | 15 + 5 = 20 | 30 | 85 | 2 | 3,371,000 | 3,277,000 |
| Example 5 | 35 + 10 = 45 | 320 | 250 | 6 | 3,297,000 | 3,189,000 |
| Example 6 | 0 + 55 = 55 | 85 | 20 | 8 | 2,993,000 | 3,008,000 |
| Example 7 | 70 + 5 = 75 | 295 | 45 | 19 | 2,815,000 | 2,736,000 |
| Comparative example 1 | 95 + 20 = 115 | 220 | 125 | 2 | 983,000 | 1,321,000 |
| Comparative example2 | 5 + 0 = 5 | 375 | 245 | 2 | 2,952,000 | 1,411,000 |
| Comparative example3 | 40 + 55 = 95 | 490 | 45 | 5 | 1,701,000 | 1,719,000 |
| Comparative example4 | 5 + 90 = 95 | 20 | 75 | 3 | 1,003,000 | 3,040,000 |
| Comparative example5 | 15 + 40 = 55 | 335 | 300 | 4 | 1,508,000 | 1,710,000 |
| Comparative example6 | 0 + 55 = 55 | 95 | 10 | 7 | 3,002,000 | 1,932,000 |
| Comparative example7 | 75 + 5 = 80 | 305 | 25 | 30 | 1,804,000 | 1,876,000 |

Referring to TABLE 2, all of the rolled copper foils in Examples 1 to 7 exhibited long bending-fatigue life of around 3,000,000 (herein, the bending-fatigue life is expressed as the number of times of bending until the rolled copper foil is broken), i.e. 2,898,000 to 3,371,000 under both of low temperature condition (i.e. 160° C. for 120 minutes) and high temperature condition (i.e. 400° C. for 60 minutes). Therefore, it is confirmed that the rolled copper foils in Examples 1 to 7 correspond to a wide temperature range, i.e. from the low temperature condition to the high temperature condition.

On the other hand, the rolled copper foil in Comparative example I exhibited short bending-fatigue life under both of the low temperature condition and the high temperature condition, namely, 983,000 under the low temperature condition (i.e. 160° C. for 120 minutes) and 1,321,000 under the high temperature condition (i.e. 400° C. for 60 minutes). It is because that the growth speed of recrystallized grain was not controlled appropriately since the total amount of silicon (Si) and/or iron (Fe) exceeded a predetermined amount.

The rolled copper foil in Comparative example 2 exhibited short bending-fatigue life under the high temperature condition, namely, 2,952,000 under the low temperature condition (i.e. 160° C. for 120 minutes) and 1,411,000 under the high temperature condition (i.e. 400° C. for 60 minutes). It is because that the growth speed of recrystallized grain was not controlled appropriately since the total amount of silicon (Si) and/or iron (Fe) was less than the predetermined amount.

The rolled copper foil in Comparative example 3 exhibited short bending-fatigue life under both of the low temperature condition and the high temperature condition, namely, 1,701,000 under the low temperature condition (i.e. 160° C. for 120 minutes) and 1,719,000 under the high temperature condition (i.e. 400° C. for 60 minutes). In Comparative example 3, the growth speed of recrystallized grain was controlled appropriately. However, since the amount of boron (B) was greater than a predetermined amount, B—Cu compound was included in the base material, thereby causing fast accumulation of the metal fatigue.

The rolled copper foil in Comparative example 4 exhibited short bending-fatigue life under the low temperature condition, namely, 1,003,000 under the low temperature condition (i.e. 160° C. for 120 minutes) and 3,040,000 under the high temperature condition (i.e. 400° C. for 60 minutes). It is because that the softening temperature (recrystallization temperature) did not fall since the amount of boron (B) was less than the predetermined amount, so that softening state (progress of the recrystallization) was insufficient at the low temperature.

The rolled copper foil in Comparative example 5 exhibited short bending-fatigue life under both of the low temperature condition and the high temperature condition, namely, 1,508,000 under the low temperature condition (i.e. 160° C. for 120 minutes) and 1,710,000 under the high temperature condition (i.e. 400° C. for 60 minutes). It is because that the growth speed of recrystallized grain was not controlled appropriately since the amount of silver (Ag) exceeded a predetermined amount.

The rolled copper foil in Comparative example 6 exhibited short bending-fatigue life under the high temperature condition, namely, 3,002,000 under the low temperature condition (i.e. 160° C. for 120 minutes) and 1,932,000 under the high temperature condition (i.e. 400° C. for 60 minutes). It is because that the growth speed of recrystallized grain was not controlled appropriately since the amount of silver (Ag) was less than the predetermined amount.

The rolled copper foil in Comparative example 7 exhibited short bending-fatigue life under both of the low temperature condition and the high temperature condition, namely, 1,804,000 under the low temperature condition (i.e. 160° C. for 120 minutes) and 1,876,000 under the high temperature condition (i.e. 400° C. for 60 minutes). In Comparative example 7, the growth speed of recrystallized grain was controlled appropriately. However, since the amount of oxygen (O) was greater than a predetermined amount, copper oxide was included in the base material, thereby causing fast accumulation of the metal fatigue.

Excellent bending-fatigue life characteristic was obtained for all of Examples 1 to 7. Particularly in Example 2 in which the amount of boron (B) was 145 ppm and Example 4 in which the amount of silver (Ag) was 85 ppm, superior bending-fatigue life characteristic was provided.

As to the concentration of oxygen (O), the amount of oxide is decreased (the factor of decreasing the bending-fatigue life is decreased) in accordance with decrease in the amount (concentration) of oxygen. In the present invention, it is confirmed that there will be no problem if the oxygen concentration is 20 ppm or less. It is preferable that the oxygen concentration is 10 ppm or less, and more preferably 5 ppm or less.

As to silicon (Si) and iron (Fe), a predetermined total amount is determined within a range of 10 ppm or more and 100 ppm or less (i.e. from 10 ppm to 100 ppm). The aforementioned effect of the embodiment can be obtained enough if the total amount falls within this range, and there is no specific condition range which is optimum within the aforementioned range. In other words, the range from 10 ppm to 100 ppm is the optimum range. The aforementioned effect of the embodiment can be provided in the case that the amount of silicon (Si) is from 10 ppm to 100 ppm when only silicon (Si) is used while iron (Fe) is not used, and the case that the amount of iron (Fe) is from 10 ppm to 100 ppm when only iron (Fe) is used while silicon (Si) is not used.

As to boron (B), a predetermined amount is determined within a range of 300 ppm or more and 400 ppm or less (i.e. from 300 ppm to 400 ppm). It would be enough if a lower limit value is 30 ppm for stabilizing the effects of the present invention. It is preferable that an upper limit value is 350 ppm (or less) for preventing the inclusion of the B—Cu compound, and more preferably 300 ppm (or less).

As to silver (Ag), a predetermined amount is determined within a range of 20 ppm or more and 250 ppm or less (i.e. from 20 ppm to 250 ppm). It is preferable that the amount of silver (Ag) is 25 ppm or more and 225 ppm or less for obtaining the stable effect, and more particularly 30 ppm or more and 200 ppm or less.

In the present application, the unit "ppm" (1 ppm=0.0001 mass %) is used. In addition, it should be noted that there will be a tolerance of plus or minus 25% at maximum for a target mass % in the actual process for manufacturing the copper alloy.

Although the invention has been described, the invention according to claims is not to be limited by the above-mentioned embodiments and examples. Further, please note that not all combinations of the features described in the embodiments and the examples are not necessary to solve the problem of the invention.

What is claimed is:

1. A rolled copper foil consisting of boron, silver, at least either of silicon and iron, and a balance consisting of copper and inevitable impurities, wherein a total amount of at least one of silicon and iron is 0.001 to 0.0045 mass %, an amount of the boron is 0.003 to 0.04 mass %, and an amount of the silver is 0.002 to 0.025 mass %.

2. The rolled copper foil according to claim 1, wherein the rolled copper foil has a thickness of 20 μm or less.

3. The rolled copper foil according to claim 1, wherein the amount of the silver is 0.0025 to 0.0225 mass %.

4. The rolled copper foil according to claim 1, wherein the amount of the silver is 0.003 to 0.02 mass %.

5. The rolled copper foil according to claim 1, wherein the amount of the silver is 0.0085 mass %.

6. The rolled copper foil according to claim 1, wherein the amount of the boron is 0.003 to 0.035 mass %.

7. The rolled copper foil according to claim 1, wherein the amount of the boron is 0.003 to 0.03 mass %.

8. The rolled copper foil according to claim 1, wherein the amount of the boron is 0.0145 mass %.

9. The rolled copper foil according to claim 1, wherein the rolled copper foil has been heat treated at 160° C. for 120 minutes.

10. The rolled copper foil according to claim 1, wherein the rolled copper foil has been formed by:

hot rolling an ingot from which the copper foil is to be made to form a hot rolled sheet;

repeatedly cold rolling and intermediate annealing the hot rolled sheet for a predetermined number of times so as to form a processed sheet;

subsequently annealing the processed sheet so as to form an annealed sheet; and cold rolling the annealed sheet so as to form a cold rolled sheet.

11. The rolled copper foil according to claim 10, wherein the cold rolled sheet has been heat treated at 160° C. for 120 minutes after the cold rolling.

12. A rolled copper foil consisting of boron, silver, oxygen of 0.002 mass % or less, at least either of silicon and iron, and a balance consisted of copper and inevitable impurities, wherein a total amount of at least one of silicon and iron is 0.001 to 0.0045 mass %, an amount of the boron is 0.003 to 0.04 mass %, and an amount of the silver is 0.002 to 0.025 mass %.

13. The rolled copper foil according to claim 12, wherein the amount of the silver is 0.0025 to 0.0225 mass %.

14. The rolled copper foil according to claim 12, wherein the amount of the silver is 0.003 to 0.02 mass %.

15. The rolled copper foil according to claim 12, wherein the amount of the silver is 0.0085 mass %.

16. The rolled copper foil according to claim 12, wherein the amount of the boron is 0.003 to 0.035 mass %.

17. The rolled copper foil according to claim 12, wherein the amount of the boron is 0.003 to 0.03 mass %.

18. The rolled copper foil according to claim 12, wherein the amount of the boron is 0.0145 mass %.

19. The rolled copper foil according to claim 12, wherein the rolled copper foil has a thickness of 20 μm or less.

20. The rolled copper foil according to claim 12, wherein the rolled copper foil has been formed by:

hot rolling an ingot from which the copper foil is to be made to form a hot rolled sheet;

repeatedly cold rolling and intermediate annealing the hot rolled sheet for a predetermined number of times so as to form a processed sheet;

subsequently annealing the processed sheet so as to form an annealed sheet; and cold rolling the annealed sheet so as to form a cold rolled sheet.

21. The rolled copper foil according to claim 20, wherein the cold rolled sheet has been heat treated at 160° C. for 120 minutes after the cold rolling.

* * * * *